United States Patent [19]

Cameron

[11] 4,099,153

[45] Jul. 4, 1978

[54] GAS EVOLVING CLAMP FOR CURRENT LIMITING FUSE

[75] Inventor: Frank L. Cameron, North Huntingdon, Pa.

[73] Assignee: Westinghouse Electric Corp., Pittsburgh, Pa.

[21] Appl. No.: 665,137

[22] Filed: Mar. 8, 1976

[51] Int. Cl.[2] ..... H01H 85/04; H01H 85/14

[52] U.S. Cl. ..... 337/159; 337/161; 337/166; 337/227; 337/290

[58] Field of Search ..... 337/158, 159, 160, 161, 337/166, 227, 290, 296

[56] References Cited

U.S. PATENT DOCUMENTS 3,706,951 12/1972 Mikulecky ..... 337/166 X

FOREIGN PATENT DOCUMENTS 600,593 6/1960 Canada ..... 337/161 X

*Primary Examiner*—Robert J. Hickey
*Attorney, Agent, or Firm*—M. J. Moran

[57] ABSTRACT

A current limiting fuse of the general purpose type utilizes a mandrel which has a plurality of longitudinally oriented and radially spaced ceramic rods around which is wound a fuse element. Gas evolving clamps are disposed along the mandrel to hold the fuse element against the rods of the mandrel. This arrangement tends to maintain the spacing of any given portion of the wound fuse element relative to the other portions thereof. In addition, the gas evolving material evolves arc quenching gas in localized regions between the clamps and the rods during a fusing operation. The pressure of the gas as it is expelled from the localized regions tends to prevent the formation of fulgurites in the regions after the fusing operation has been completed. A fulgurite if formed would enhance the opportunity for a restrike of the arc which is undesirable.

6 Claims, 12 Drawing Figures

GAS EVOLVING CLAMP FOR CURRENT LIMITING FUSE

CROSS REFERENCE TO RELATED APPLICATONS

The subject matter of this invention is related to the subject matter of copending application Ser. No. 396,919, filed Aug. 27, 1973 by H. L. Miller and entitled "Current Limiting Fuse With Improved Spacing Between Parallel Elements", and is also related to allowed but not issued application Ser. No. 483,602 by D. D. Blewitt entitled "High Voltage Fuse With Localized Gas Evolving Suppressors".

BACKGROUND OF THE INVENTION

This invention relates generally to current limiting fuses and specifically to general purpose current limiting fuses having localized regions of evolved gas for arc-quenching and suppressing.

Current limiting fuses of the type which utilize the voltage of the fuse arc for current limitation are known. It is also known to provide pulverulent arc quenching material or sand to absorb the energy of a burning or fusing fuse element during the fusing process so that the fuse will not explode during the fusing operation. It is also known to provide mandrels or cores of gas evolving material to evolve an arc quenching gas during the fusing operation. The sand tends to confine the arc radially and thus sustain its current limiting voltage in addition to absorbing the energy of the arc. However, the evolved gas exerts pressure against the inside of the fuse housing and ferrules which may lead to rupture of the fuse housing or blow off of the ferrules. It is also known that the amount of evolved gas may be reduced by providing certain types of mandrels or support beams which evolve gas locally in controlled small quantities so that the pressure within the fuse housing does not increase significantly even through the positive effects of the presence of arc suppressing gas are generally maintained. Fuses of this type are described in the previously mentioned copending application Ser. No. 483,602 and in U.S. Pat. No. 3,437,971, entitled "Current Limiting Fuse", issued to H. W. Mikulecky on Apr. 8, 1969 and U.S. Pat. No. 3,569,891, entitled "Current Limiting Fuse" issued to F. L. Cameron on Mar. 9, 1971 and assigned to the same assignee as the present application. The previously mentioned application Ser. No. 483,602 represents an advance in the state of the art inasmuch as the production of arc quenching gas is significantly reduced even though the benefits of the presence of the arc quenching gas are not significantly reduced. Other patents which are of interest are U.S. Pat. No. 3,374,328 issued Mar. 19, 1968 to F. L. Cameron and entitled "Cartridge Type Fuse With Explosion Pots" and U.S. Pat. No. 3,810,062, issued May 7, 1974 to F. J. Kozacka and entitled, "High Voltage Fuse Having Full Range Clearing Ability". In the above-mentioned patents or applications, the apparatus described therein forms fulgurites, i.e., fused pulverulent arc-quenching material, after a fusing operation has taken place. The fulgurite provides a disadvantage of providing a path for a restrike of the arc current. It would be advantageous if a current limiting fuse could be found or developed which utilized the properties of energy-absorbing, pulverulent, arc-quenching material and localized gas-evolving suppressors, but which additionally reduced the tendency of arc restrike by reducing the tendency of fulgurite formations as a by-product of the fusing operation. It would also be advantageous to provide a wound fuse element which generally remained spaced, one turn from another, before and as long as possible during the fusing operation, to prevent or reduce inter-turn voltage breakdown.

BRIEF SUMMARY OF THE INVENTION

In accordance with the invention, a general purpose current limiting fuse is provided which utilizes pulverulent arc-quenching material and localized evolvement of arc suppressing gas, while at the same time reducing the tendency for forming fulgurites. A fuse wire or ribbon, either singly or in parallel with others, is wound around a support mandrel which has a number of ceramic, non-gas evolving, electrical insulating rods. The rods are arranged longitudinally of the barrel of the fuse, but circumferentially spaced from each other at equal radii about the centerline of the fuse. C-shaped clamps which are flexible and which comprise gas-evolving material, such as glass-melamine or polyester, are inserted longitudinally of the support member. Consequently, each fuse element is maintained in a relatively fixed disposition even during the fusing operation to deter winding-to-winding voltage breakdown. Those places on the ceramic rods where the fuse element and gas-evolving clamp intersect are generally regions of localized gas-evolvement during the fusing operation. There is little or no consequential fulgurite formation because of the relatively tight interfacing between the rod, fuse element and clamping member.

BRIEF DESCRIPTION OF THE DRAWINGS

For a better understanding of the invention, reference may be had to the preferred embodiments thereof shown in the accompanying drawings in which.

DESCRIPTION OF THE PREFERRED EMBODIMENTS

Figure 1:
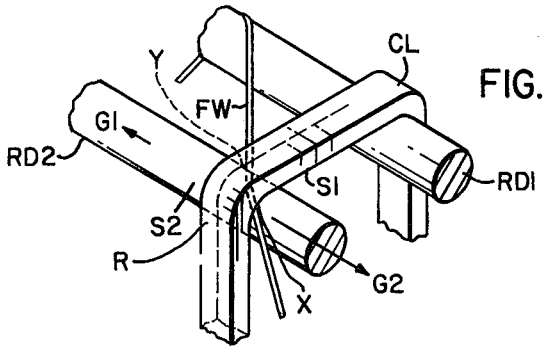
FIG. 1 shows an orthogonal view of a partially broken away and cutaway portion of a fuse which utilizes a gas-evolving, arc suppressing clamp.

Referring now to the drawings and FIG. 1 in particular, a preferred embodiment of the present invention is shown. In this case, two ceramic, electrically insulating, non-gas evolving rods RD1 and RD2 are shown disposed in a spaced-apart generally parallel disposition. There is shown supported by the rods RD1 and RD2 a section of fuse wire FW which crosses rods RD1 and RD2 in a biased direction. There is also shown a portion of a gas evolving, generally flexible clamp CL which is securely fixed by a self-clamping action around the rods RD1 and RD2 and which intersects the wire FW at a region R along the rod RD2. The radius of curvature of the clamp in the vicinity of the rod RD2 is generally equal to the radius of the curvature of the rod so that the fuse wire FW is snugly secured between the clamp CL and the rod RD2 in the region R. The inner surface S1 of the clamp CL is firmly pressed against the wire FW very close to the outer curvalinear surface S2 or the rod RD2. Consequently, the wire FW is disposed in intimate contact with both the rod RD2 and the gas-evolving clamp or suppressor means CL between the points X and Y. As the fuse element burns or melts during a fusing operation in the region R, the gas-evolving material from a region near the surface S2 of the clamp CL cools and suppresses the radial expansion of the arc which is formed along the vaporizing fuse wire FW. In addition, the confined space between the surface S2 of the ceramic rod RD2 and the surface S1 of the clamp CL causes the gas and melted fuse element portion to forcefully move outwardly in directions such as G1 and G2 to prevent entry of sand or other pulverulent arc-quenching material. Consequently, after the fusing has taken place and the fuse wire FW has entirely been destroyed due to the fusing action, a region generally corresponding to region R and generally existing between the points X-Y will not be occupied by a fulgurite but rather will generally comprise a region of high insulation. This deters restrike of the arc in the fuse in this region. It is to be understood that in a preferred embodiment of the invention a number of parallel spaced rods RD1, RD2, etc., are utilized and the clamp CL is C-shaped such that it might intersect the fuse wire FW in a number of places. The simplicity of the apparatus shown in FIG. 1 is for the purpose of illustrating an inventive concept. The pressure exerted by the clamp CL on the fuse wire FW against the rod RD2 maintains the fuse wire in fixed space relationship during shipping or operation of the fuse in which the entire apparatus is disposed. During the actual fusing operation, the mere presence of the surface S1 of the clamp CL and the surface S2 of the rod RD2 in the region R prevents substantial radial expansion of the arc in this region, this is in addition to the enhanced arc properties made possible by the evolvement of gas in the latter region.

Figure 2:
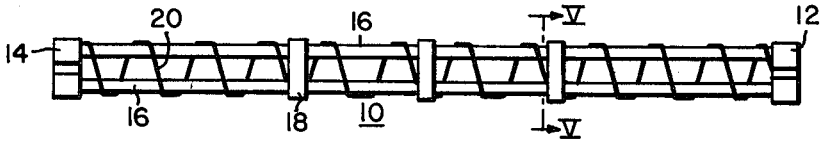
FIG. 2 shows a wound support arrangement using a single wire and cooperating clamp members.

Referring now to FIG. 2, an embodiment of the invention utilizing a fuse wire 20 is shown. There is provided a single wire fuse element assembly 10 comprising two end members 12 and 14, which may be electrically insulating, and four circumferentially spaced rods 16 which are supported by the end of portions 12 and 14. The fuse element 20 is wound around the mandrel comprising the four rods 16 from end piece 14 to the other end piece 12. Flexible clamps 18 are provided which secure the wound fuse element 20 against the rods 16 at strategic locations. These are places where the fuse element intersects both a rod 16 and a clamp CL for evolving gas without generally forming fulgurite regions.

Figure 3:
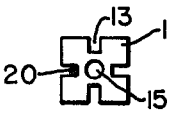
FIG. 3 shows the apparatus of FIG. 2 viewed from the right side of FIG. 2.

Referring now to FIG. 3, the end piece 12 is shown in side view. It will be noted that in this embodiment of the invention the end piece 12 comprises a rectangular member having angularly disposed spaced grooves 13 and a central filling hole 15. The fuse element 20 is shown feeding through the leftmost opening, hole or groove 13 in the end piece 12.

Figure 4:
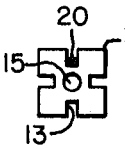
FIG. 4 shows the apparatus of FIG. 2 viewed from the left side of FIG. 2.

Referring now to FIG. 4, the left end piece 14 is shown. It will be noted that the left end piece 14 is substantially the same as the right end piece 12 in that it comprises electrically insulating material having angularly displaced grooves 13 and a filling hole 15. The wire portion 20 is shown in this case extending through the topmost groove 13 in the end piece 14.

Figure 5:
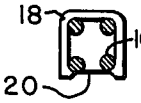
FIG. 5 shows a cross-sectional view of the member shown in FIG. 2 at the section V—V.

Referring now to FIG. 5, one of the clamps 18 is shown as it is disposed on the rods 16. It will be noted that the clamp 18 is generally flexible, comprises a C-shaped or U-shaped element with self-locking ribs on the inner surface of the arms thereof, which essentially can be fit over the mandrel after assembly and which is firmly secured against the rods 16. The fuse wire 20 is shown crossing the lower portion of the mandrel comprising the non-gas evolving rods 16. It is to be understood, of course, that the path of the wire 20 encloses all of the rods 16. The view of FIG. 5 corresponds to the section V—V shown in FIG. 2.

Figure 6:
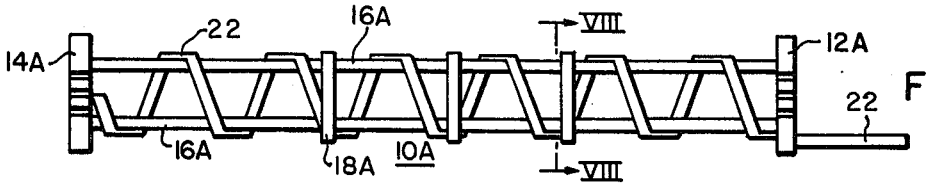
FIG. 6 shows a support member similar to that of FIG. 2, but which incorporates a fuse ribbon rather than a fuse wire.

Referring now to FIG. 6, still another fuse element assembly 10A is shown. Fuse assembly 10A comprises a single fuse ribbon 22 but otherwise is essentially the same in construction as the fuse apparatus 10 shown in FIG. 2. End pieces 12A and 14A, which are similar to end pieces 12 and 14 respectively of FIGS. 2, 3 and 4, have disposed therebetween four longitudinal rods 16A similar to the longitudinal rods 16 shown in FIG. 2. There is wound around the support piece or mandrel formed by the rods 16A the fusible ribbon 22 which traverses the single ribbon fuse support member 10A from the insulating support means 14A on the left to the insulating support means 12A on the right.

Figure 7:
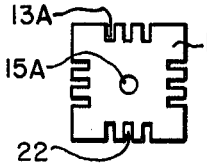
FIG. 7 shows a right side view of the apparatus of FIG. 6.

Referring now to FIG. 7, the support piece 12A is shown in side view. It will be noted that a sand entry port 15A similar to the port 15 of FIG. 3 is also shown. There are disposed on each side of the relatively square support end piece 12A three grooves or openings 13A for accepting and supporting fuse elements. The fuse element 22 is shown extending outwardly from the middle groove of the bottom set of grooves 13A of the end piece 12A.

Figure 8:
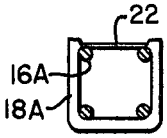
FIG. 8 shows a cross-sectional view of the apparatus of FIG. 6 at the section VII—VII.

Referring now to FIG. 8, a clamp 18A which is similar to the clamp 18 shown in FIG. 5 is shown at the section VIII—VIII of FIG. 6. It will be noted that, as was the case with respect to FIG. 5, the four rod members 16A have disposed therearound a clamp member 18A. The fuse ribbon 22 is shown extending across the space between the two uppermost rods 16A as viewed in FIG. 8.

Figure 9:
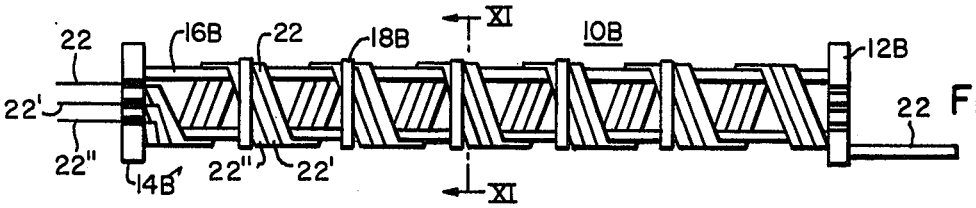
FIG. 9 shows a multi-parallel fuse ribbon apparatus similar to the apparatus of FIGS. 2 and 6.

Referring now to FIG. 9, still another embodiment of the invention is shown which includes an assembly 10B. As was the case with respect to the apparatus 10 and 10A of FIGS. 2 and 6 respectively, the apparatus 10B comprises right and left electrically insulating end pieces 12B and 14B respectively which, for example may be the same as members 12A and 14A of FIG. 6. Here are also interconnecting longitudinally disposed and radially spaced support rods 16B which form a mandrel around which three parallel fuse elements 22, 22′ and 22″ are wound. There are provided in this embodiment of the invention five clamps 18B, each of which may be similar to the clamp 18A shown in FIG. 8, or the clamp 18 shown in FIG. 5.

Figure 10:
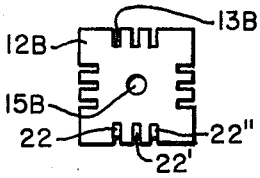
FIG. 10 shows a view of the apparatus of FIG. 9 at the right side of FIG. 9.

FIG. 10 shows a side view of support element 12B, which is essentially the same as support element 12A shown in FIG. 7. In this embodiment of the invention there is also a sand filler entry port 15B, which is similar to port 15A, and grooves 13B, which are similar to grooves 13A in the apparatus in FIG. 7. In this embodiment of the invention, however, three fuse elements 22, 22' and 22'' are shown extending outwardly from the three grooves 13B on the bottom of the end piece 12B shown in FIG. 10.

Figure 11:
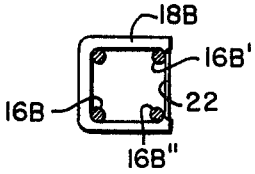
FIG. 11 shows a cross-sectional view of the apparatus of FIG. 9 at the section XI—XI.

Referring now to FIG. 11, one of the clamps 18B shown in FIG. 9 is viewed at the section XI—XI of FIG. 9. As was the case before, four spaced rods 16B have disposed therearound the generally flexible gas-evolving clamp 18B. The ribbon 22 is shown extending downwardly from the upper rightmost rod 16B' to the lower rightmost rod 16B''.

Figure 12:
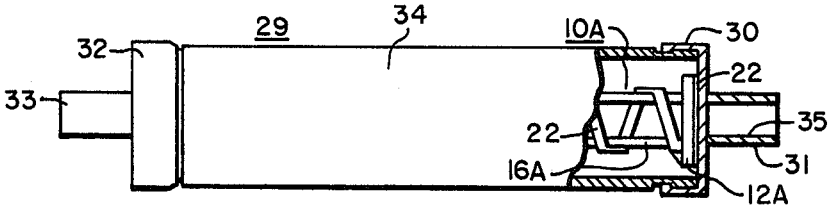
FIG. 12 shows a completed fuse assembly, partially in section and partially broken away, utilizing the fuse support apparatus of FIG. 6.

Referring now to FIG. 12, a partially broken away, partially sectional, side elevation of a general purpose current limiting fuse 29 is shown. In this embodiment of the invention there are provided end ferrules or electrically conducting portions 30 and 32 on the right and left ends, respectively, of an electrically insulating fuse barrel or housing 34. There are extending outwardly from the ferrules 30 and 32 generally hollow current carrying mounting members 31 and 33 respectively. The members 31 and 33 may be utilized for mounting the fuse in a convenient mounting apparatus (not shown). Shown internal to the cavity of the fuse housing 34 is the fusing apparatus 10A of FIG. 6, it being understood that the other fusing apparatuses 10 and 10B of FIG. 2 and FIG. 9, respectively, may also be disposed in the aforementioned central cavity. The wound fuse ribbon 22 is shown disposed upon the rods 16A. The rightmost portion of the fuse ribbon 22 as viewed in FIG. 6 is oriented between the end piece 12A and the inner surface of the right ferrule 30, so as to provide electrical continuity between the fuse element 22 and the ferrule 30. It is envisioned that an external electric circuit which is to be protected by the fuse 29 may be connected at one end of the fuse to ferrule 32 and at the other end of the fuse to ferrule 30.

It is to be understood with respect to the embodiment of this invention that they are not limited to mandrels of only four rods, 16, 16A, etc., such as are shown in FIGS. 5, 8 and 11, for example. It is also to be understood that the relative number of clamps such as 18, 18A and 18B is not limited by the number shown in the FIGS. 2, 6 and 9, for example. It is also to be understood that the particular construction features of the end pieces 12, 12A, 12B and 14, 14A and 14B are not limiting. It is also to be understood that the orientation of the clamps on the mandrel formed by the rods is not limiting, i.e., the open parts of the C-shaped clamp member may point in any convenient direction including different directions for different clamps in the same fuse.

The apparatus taught in the present invention has many advantages. One advantage lies in the fact that utilization of fuse clamps such as 18B shown in FIG. 9 tends to space the windings 22, 22' and 22'', for example, in a relatively fixed disposition before and during a fusing operation. This deters or prevents interwinding voltage breakdown which may occur if parallel fuse elements are allowed to longitudinally move closer to one another during a fusing operation or prior to fusing, as is sometimes the case in the prior art. Another advantage lies in the fact that the physical constraint provided by the inner surface of the clamp CL and the outer surface of the rod RD2 of FIG. 2 serves to prevent the arc from substantially expanding in a radial direction. This tends to maintain the arc in a current limiting state.

What I claim as my invention is:

1. A current limiting fuse, comprising:

a. fuse housing means having an internal cavity;

b. spaced ferrule means disposed upon said fuse housing means for interconnection with external circuit means and for communicating with said internal cavity;

c. a plurality of longitudinally oriented radically spaced non-gas evolving electrically insulating rods disposed within said internal cavity for supporting a fuse element means thereon;

d. fuse element means disposed within said internal cavity and wound around said rods and in electrical contact with said spaced ferrule means for fusing when a predetermined amount of electrical current is passed therethrough and for limiting said current to thus protect said external circuit means;

e. pulverulent arc quenching material disposed within a substantial portion of said internal cavity for absorbing energy from said fuse element means during a fusing operation; and f. a gas evolving member disposed within said internal cavity in physical contact with said fuse element means and proximate to said support means for providing a region where gas is evolved during a fusing operation for quenching the electric arc which occurs during fusing, said generated gas being generally expelled from said region to thus keep said region generally free from fused pulverulent arc quenching material after said fusing operation has been completed to thus deter the restriking of said arc therein.

2. The combination as claimed in claim 1, wherein said gas evolving member comprises a clamp which is disposed around said rods and which periodically contacts said fuse element means at a place where said fuse element means touches one of said rods.

3. The combination as claimed in claim 2 wherein said clamp maintains a predetermined disposition of said fuse element means upon said rods by compressing said fuse elements means against one of said rods.

4. A current limiting fuse, comprising:

a. fuse housing means having an internal cavity;

b. spaced ferrule means disposed upon said fuse housing means for interconnection with external circuit means and for communicating with said internal cavity;

c. a plurality of longitudinally oriented radially spaced electrically insulating support means disposed within said internal unity for supporting a fuse element means thereon;

d. fuse element means disposed within said internal cavity, wound around said plurality of support means and in electrical contact with said spaced ferrule means for fusing when a predetermined amount of electrical current is passed therethrough and for limiting said current to thus protect said external circuit means;

e. pulverulent arc quenching material disposed within a substantial portion of said internal cavity for absorbing energy from said fuse element means during a fusing operation; and f. flexible clamp means disposed around said plurality of support means to maintain a predetermined disposition of said fuse element means upon said plurality of support means by compressing said fuse element means against said support means.

5. The combination as claimed in claim 4 wherein said support means comprises rods of ceramic material.

6. The combination as claimed in claim 4 wherein said clamp means comprises gas evolving material for providing arc quenching gas to a region where said fuse element means has become vaporized to form an arc during a fusing operation.

* * * * *